US005791074A

United States Patent [19]

Pryor

[11] Patent Number: 5,791,074

[45] Date of Patent: Aug. 11, 1998

[54] DREDGE

[75] Inventor: Murray Howard Pryor, Sydney, Australia

[73] Assignee: Minpro Australia N.L., Glebe, Australia

[21] Appl. No.: 583,040

[22] PCT Filed: Jul. 12, 1994

[86] PCT No.: PCT/AU94/00388

§ 371 Date: Jul. 1, 1996

§ 102(e) Date: Jul. 1, 1996

[87] PCT Pub. No.: WO95/02734

PCT Pub. Date: Jan. 26, 1995

[30] Foreign Application Priority Data

Jul. 15, 1993 [AU] Australia ..... PL9960

[51] Int. Cl.[6] ..... E02F 3/34; E02F 9/00; B63H 19/08

[52] U.S. Cl. ..... 37/345; 37/312; 440/36

[58] Field of Search ..... 37/312, 317, 320, 37/341, 342, 343, 345, 346, 340; 440/36

[56] References Cited

U.S. PATENT DOCUMENTS

| | | | |
|---|---|---|---|
| 1,792,065 | 2/1931 | Bowers . | |
| 1,913,670 | 6/1933 | Hindes . | |
| 2,850,814 | 9/1958 | Elliott, Jr. . | |
| 3,521,387 | 7/1970 | Deyelman | 37/345 X |
| 3,739,503 | 6/1973 | Barker et al. | 37/345 X |
| 4,399,623 | 8/1983 | Neumann | 37/73 |
| 4,445,290 | 5/1984 | Oules | 37/66 |
| 4,547,162 | 10/1985 | Little | 37/346 X |
| 4,676,052 | 6/1987 | Hawk | 37/340 X |
| 5,145,425 | 9/1992 | Little | 440/36 |
| 5,311,682 | 5/1994 | Sturdivant | 37/346 X |

FOREIGN PATENT DOCUMENTS

| | | |
|---|---|---|
| 74858/74 | 6/1976 | Australia . |
| 24605/77 | 11/1978 | Australia . |
| 37292/78 | 1/1980 | Australia . |
| 548.649 | 1/1923 | France . |

*Primary Examiner*—Michael J. Carone
*Assistant Examiner*—Robert Pezzuto
*Attorney, Agent, or Firm*—Jacobson, Price, Holman & Stern, PLLC

[57] ABSTRACT

A dredge including a V-shaped or U-shaped pontoon having a first leg and a second leg. The legs have effective longitudinal axes that diverge from one another by an angle of no more than 180°. Spuds or similar anchoring devices are connected to each of the respective pontoon legs by slides that allow the pontoon to be advanced relative to a substrate to which the spuds are anchored. A bucket wheel is suspended from the pontoon by a dredge ladder. A slewing device is provided to cause the dredge ladder, and the bucket wheel attached to it, to be slewed from side to side relative to the legs of the pontoon, about a substantially vertical axis.

15 Claims, 6 Drawing Sheets

DREDGE

FIELD OF THE INVENTION

The present invention relates to a dredge, and more particularly to a dredge having improved control over positioning and lateral cutter head forces.

BACKGROUND

A dredge usually comprises a floating pontoon, a dredge ladder attached to the pontoon, and a rotating cutter head located at a far end of the dredge ladder. The cutter head is used for cutting or removing dredgeable material as the dredge slews about a substantially vertical axis, and the substantially vertical axis is advanced in a forward direction.

There are a number of methods used for simultaneously advancing the dredge, causing the cutter head to make and maintain contact with uncut dredgeable material, and providing the force necessary to resist the cutting reaction as the cutter head slews and rotates.

A first method uses a three-wire system in which a wire extends laterally and forwardly from each of the two sides of the pontoon. Each of the two wires is anchored ashore, passes through a respective pulley attached to the dredge ladder, and continues on to a respective slew winch on the pontoon or ladder. The slew winches exert forces on the two wires to pull the dredge forward onto the face of the uncut dredgeable material, and laterally to resist the reaction from the cutting force as the cutter head cuts the dredgeable material. A third wire, the tail wire, passes from an anchor point to a tail winch, and this is used to position the dredge longitudinally.

The three-wire system is currently the least expensive dredging system. It is effective in dredging ponds which are wide, shallow, have good access for changing anchoring positions, and have low banks. However, in ponds which do not satisfy these criteria, the three-wire system is less effective. Specifically, in narrow, deep ponds, the three-wire system has the following disadvantages:

(1) it requires the anchoring positions to be moved frequently;

(2) the horizontal force available to advance the dredge is relatively small;

(3) the elastic nature of the tail wire results in non-uniform cutting of the face;

(4) there is only a relatively small lateral force available to resist the cutting forces; and (5) the slew wires, which are aerial wires, may foul equipment, become embedded in the face of the material being dredged, or present a hazard to operating personnel.

These disadvantages are alleviated to a certain extent by a conventional spud dredge in which a long vertical post, or spud, provides a pivot point at the stern of the pontoon. The spud is mounted on a sliding carriage, and the cutter head is forced forward against the face by causing the carriage to move backwards relative to the dredge.

In an arrangement similar to the three-wire system, lateral force to resist the cutting reaction is provided in a conventional spud dredge by slew winches which pull on wires extending forwardly and laterally from the dredge ladder (see for example, U.S. Pat. Nos. 4,399,623; 4,445,290; and 5,145,425). However, in the spud dredge, these wires are usually anchored to the pond bed.

One of the disadvantages of the conventional spud dredge is that the spud may not provide an anchor which is firm enough. This is especially relevant when a spud dredge is used for tailings recovery in which the pond bed may be particularly soft. In order to provide a sufficiently firm anchor, the spud must be driven deeply into the pond bed, and, in this case, the bending moments on the spud and the dredge may be large.

Thus, it is desirable to provide a dredge which can be positioned accurately and firmly, and which uses no aerial wires which can foul equipment or present a hazard to operating personnel.

SUMMARY OF THE INVENTION

The present invention consists in a dredge comprising:

a pontoon including a first leg having a first effective longitudinal axis and a second leg having a second effective longitudinal axis, the first leg and the second leg being oriented such that the first effective longitudinal axis and the second effective longitudinal axis diverge from one another toward their forward ends and define an included angle, the included angle being less than 180 degrees;

a first anchoring means mounted on the first leg adjacent to a forward end of the first leg for anchoring the first leg to an adjacent substrate;

a second anchoring means mounted on the second leg adjacent to a forward end of the second leg for anchoring the second leg to the adjacent substrate;

a collection means, attached pivotally to the pontoon between the first leg and the second leg and rearwardly of them, for collecting dredgeable material;

slewing means associated with the first leg and the second leg for causing the collection means to slew between the first and second leg about a substantially vertical axis; and advancing means for causing the pontoon to advance relative to the adjacent substrate.

The legs of the pontoon may be straight in which case the effective longitudinal axis of each leg is straight. Alternatively one, or each, leg may be curved or bent. In this case the effective longitudinal axis of the leg will be a notional line drawn between the most rearwardly point of proximity of that leg with the other leg and a point on that leg which is the forward and laterally outermost point of that leg. The legs preferably each have a segment that lies parallel to a longitudinal axis of the dredge.

Preferably, the first anchoring means comprises a spud mounted slidably yet lockably on the first leg. Preferably, the second anchoring means comprises a spud mounted slidably yet lockably on the second leg. Each of these spuds is preferably mounted on a slide connected to a respective one of the first and second legs and constituting the advancing means. These slides are preferably arranged to extend in a direction substantially parallel to a longitudinal axis of the dredge.

The anchoring means are mounted adjacent respective forward ends of the first and second legs and are preferably as widely spaced from one another as is reasonably possible. The collection means is preferably pivotally connected to the pontoon rearwardly relative to the spuds. These arrangements provide two major advantages. Firstly, the slewing means apply a pulling force to the collection means which is as nearly normal to the longitudinal axis of the dredge as is possible. This reduces the force that must be applied through the slewing means to a minimum. Secondly, as the width between the anchoring means decreases so the force thereon increases. Thus by spreading the anchoring means widely apart the likelihood of the anchoring means being inadvertently displaced during use of the dredge is reduced.

The collection means, which preferably comprises a bucket wheel connected to a free end of a dredge ladder, may be mounted directly on the pontoon. Alternatively, it may be mounted on a further pontoon pivotally connected to the first pontoon.

The pontoon may comprise an integral structure having

In a yet further embodiment, the ends of the V-or U-shape may be connected by a curved beam and a centre pontoon may be connected between the curved beam and the apex of the V-or U-shape to give a generally B-shaped pontoon.

Preferably, the slewing means includes a plurality of slewing wires arranged to supply lateral forces to the collection means. Preferably, the slewing wires are secured to the anchoring means or to another member extending downwardly from the underside of the pontoon.

Preferably, the collection means includes a bucket wheel attached to a dredge ladder.

BRIEF DESCRIPTION OF THE DRAWINGS

The invention will be described with reference to the accompanying figures in which.

BEST MODES OF CARRYING OUT THE INVENTION

Figure 1:
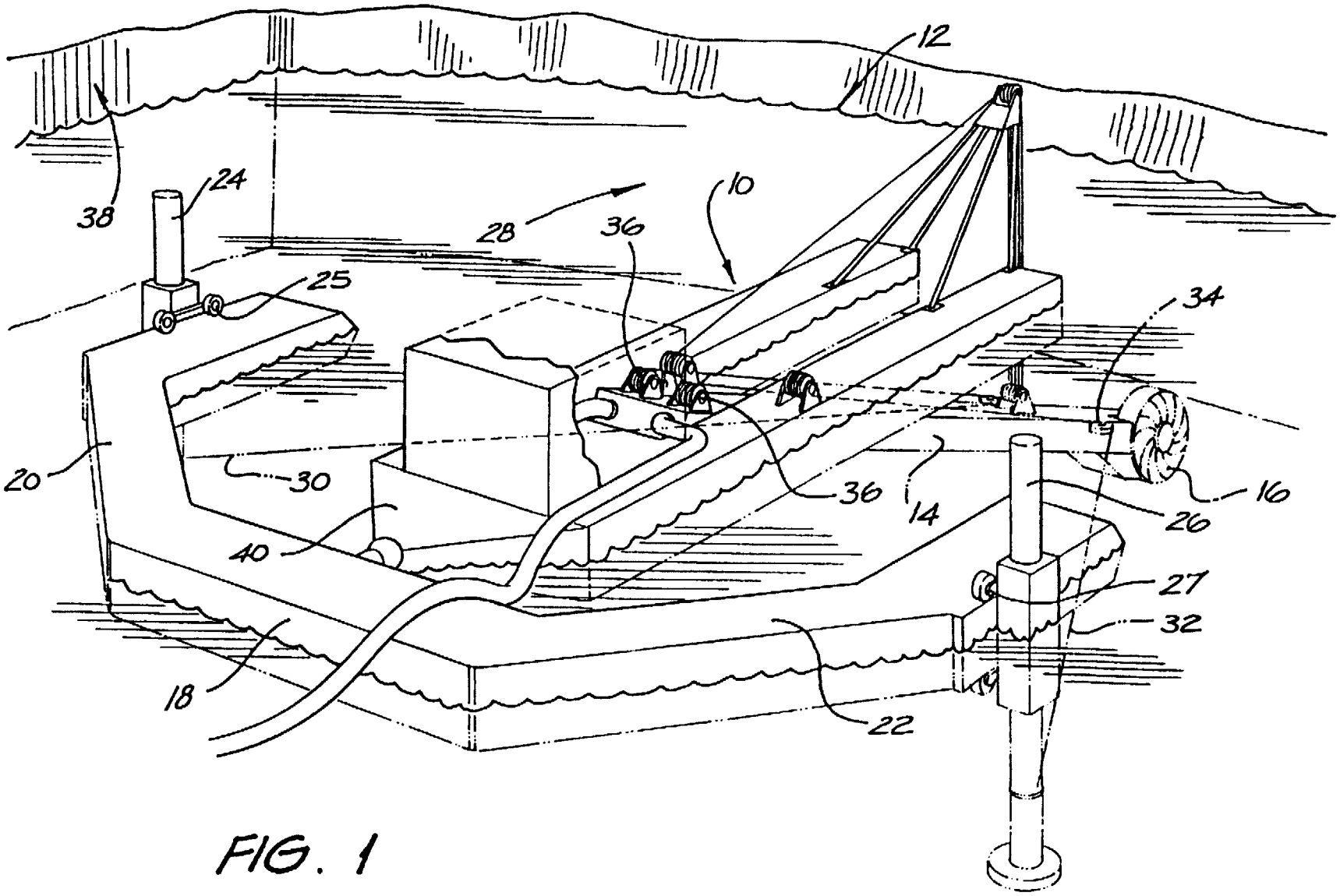
FIG. 1 is a perspective, partially cut-away view of a first preferred embodiment of a dredge in accordance with the present invention.

A first preferred embodiment of the present invention is shown in FIG. 1. Dredge 10, afloat in pond 12, is fitted with dredge ladder 14 to which is attached cutter head 16. Dredge 10 is connected pivotally at its stern to U-shaped (or V-shaped) pontoon 18 which comprises first leg 20 and second leg 22. First spud 24 is slidably yet lockably mounted on a first carriage 25 on first leg 20, and second spud 26 is slidably yet lockably mounted on a second carriage 27 on second leg 22.

Forward movement of dredge 10 is provided by forcing first spud 24 and second spud 26 to slide backwards on their carriages 25 and 27 with respect to U-shaped pontoon 18. In so moving, U-shaped pontoon 18 causes dredge 10 and cutter head 16 to move forward towards face 28 which comprises material to be dredged.

Slew wires 30 and 32 are secured to first spud 24 and second spud 26, pass through pulleys 34 on dredge ladder 14, and are attached to slew winches 36. In the first preferred embodiment, slew wires 30 and 32 are attached to eyes in spuds 24 and 26 at positions approximately half-way down the spuds when these spuds are driven into the pond bed.

Slew winches 36 exert forces on slew wires 30 and 32 to provide lateral movement of cutter head 16 along face 28. This movement is achieved by providing a difference between the forces exerted on slew wires 30 and 32. Thus, for example, if slew winches 36 are operated such that the force exerted on slew wire 30 exceeds the force exerted on slew wire 32, then cutter head 16 will tend to move towards bank 38. In so doing, it will cut an arc along face 28 towards bank 38. Conversely, if slew winches 36 are operated such that the force exerted on slew wire 32 exceeds the force exerted on slew wire 30, then cutter head 16 will cut an arc along face 28 away from bank 38.

Preferably, the distance between first leg 20 and second leg 22 should be such that the spuds 24 and 26 can operate on the flat bed of the pond rather than on the sloping sides of the cut face of the bank 38.

First spud 24 and second spud 26 can be made to move backwards simultaneously or alternately, and they are preferably indexed, i.e., made to move in discrete steps. If spuds 24 and 26 are indexed alternately in discrete steps of the same size, then dredge 10 will cut a straight path, and it will move forward until it reaches the limit of travel allowed by the carriages 25 and 27.

When this limit of travel is reached, spuds 24 and 26 can be repositioned on the carriages to enable dredge 10 to continue its forward movement. In order to reposition first spud 24, cutter head 16 is stopped from rotating and lowered to the bed of pond 12, and first spud 24 is raised. At this stage, cutter head 16 and second spud 26 hold dredge 10 in position. First spud 24 can then be repositioned to allow further travel, and finally lowered again. An analogous procedure can be followed to reposition second spud 26.

Spuds 24 and 26 can also be indexed in discrete steps of unequal size. In this case, dredge 10 will cut a curved path having a predictable radius of curvature. The radius of curvature is governed by the difference in the sizes of the discrete steps, and is limited by the flexibility of the dredge and pontoon structure.

The procedures to be followed to advance the dredge can be followed manually, or can be automated. In either case, limit switches associated with the carriages, or other position sensing devices, can be used to determine the need for repositioning spuds 24 and 26.

Advantageously, unlike conventional "walking" spud dredges, in this invention, the forces acting on spuds 24 and 26 have substantially the same magnitudes as the lateral, or cutting, force exerted by the cutting head on face 28, and as the forward force exerted on the dredge. The attachment of slew wires 30 and 32 to an intermediate point on spuds 24 and 26 limits the bending moments on those spuds. In addition, in the present invention, the force required to move the dredge forward can be distributed between two spuds.

U-shaped pontoon 18 is subjected to large torsional forces and bending moments. To be able to withstand these forces whilst still maintaining buoyancy, U-shaped pontoon 18 is preferably constructed as a hollow box section with regularly spaced diaphragms. Such a construction provides flotation and structural strength, and is easily protected from the corrosive environment associated with dredging. U-shaped pontoon 18 should preferably have sufficient mass and buoyancy at the ends closest to the cutting wheel that it can provide a stable platform into which some of the forces acting on spuds 24 and 26 can be dissipated.

The spud carriages can be mounted on outer edges of first leg 20 and second leg 22. The carriages can also be mounted such that they can run off the ends of legs 20 and 22, and swing up and out of the way if dredge 10 is pushed back by a collapse of face 28. In addition, if sharp-edged, hollow cylinders are used at the lower ends of spuds 24 and 26 for limited penetration into the substrate and increased cross-section, then these cylinders can be provided with release mechanisms. Such mechanisms could release the cylinders from spuds 24 and 26 when the spuds are subjected to predetermined shear forces or bending moments such as would be experienced if the face 28 collapses.

The major force transmitted from U-shaped pontoon 18 to dredge 10 is a forward force which acts substantially along the longitudinal centreline of dredge 10. In addition, some vertical forces are also applied to dredge 10. In order to accommodate these forces while still allowing dredge 10 to slew, the first preferred embodiment uses pyramidal section 40 to form the stern of dredge 10. Preferably, the apex of pyramidal section 40 is attached pivotally to U-shaped pontoon 18 using a spherical seated bearing with a substantially vertical shaft axis. Such an arrangement enables the required force to be transmitted, allows dredge 10 to slew without fouling U-shaped pontoon 18, and allows dredge 10 to list under the influence of cutting forces and buoyancy changes.

Figure 2:
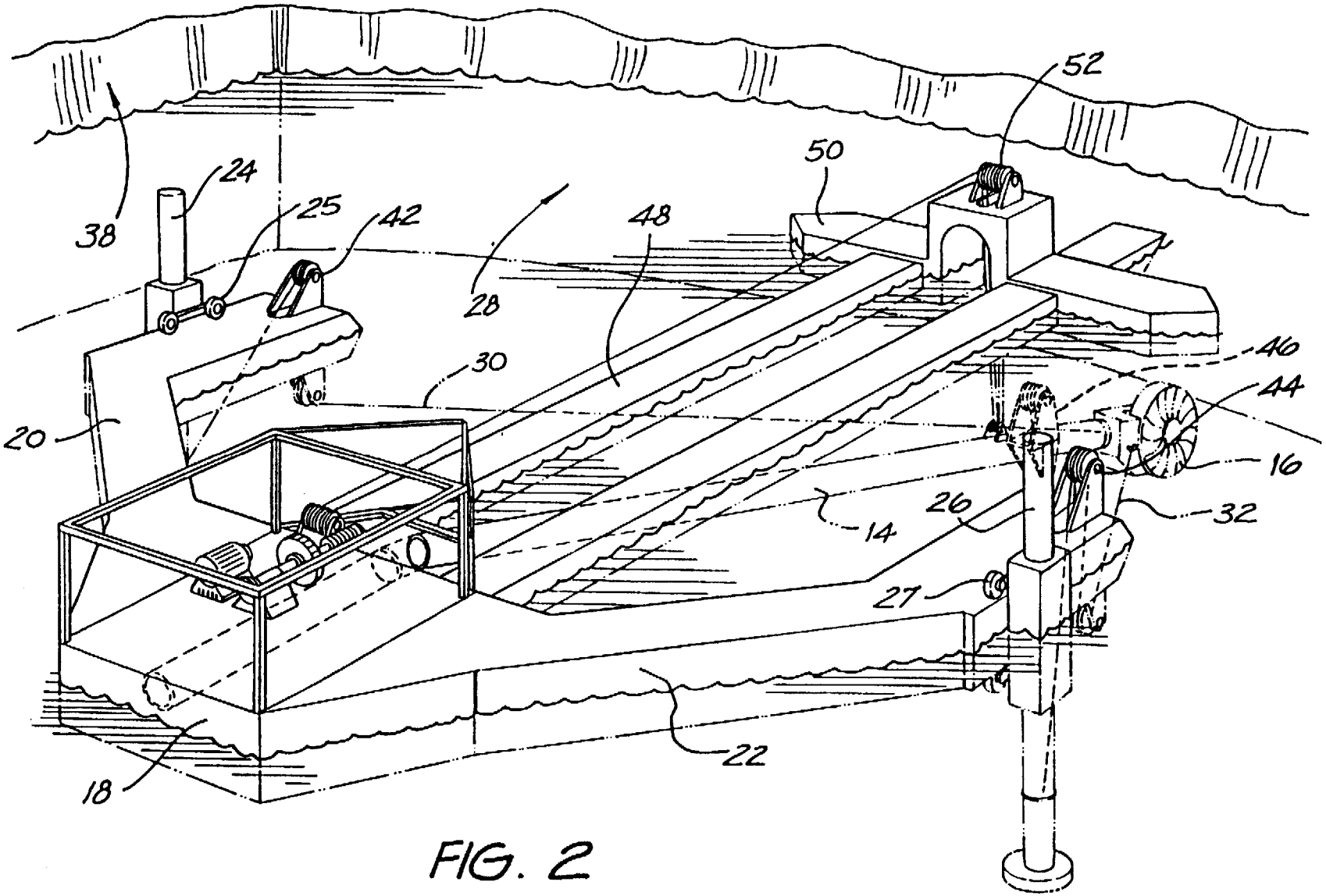
FIG. 2 is a perspective, partially cut-away view of a second preferred embodiment of a dredge in accordance with the present invention.
Figure 3:
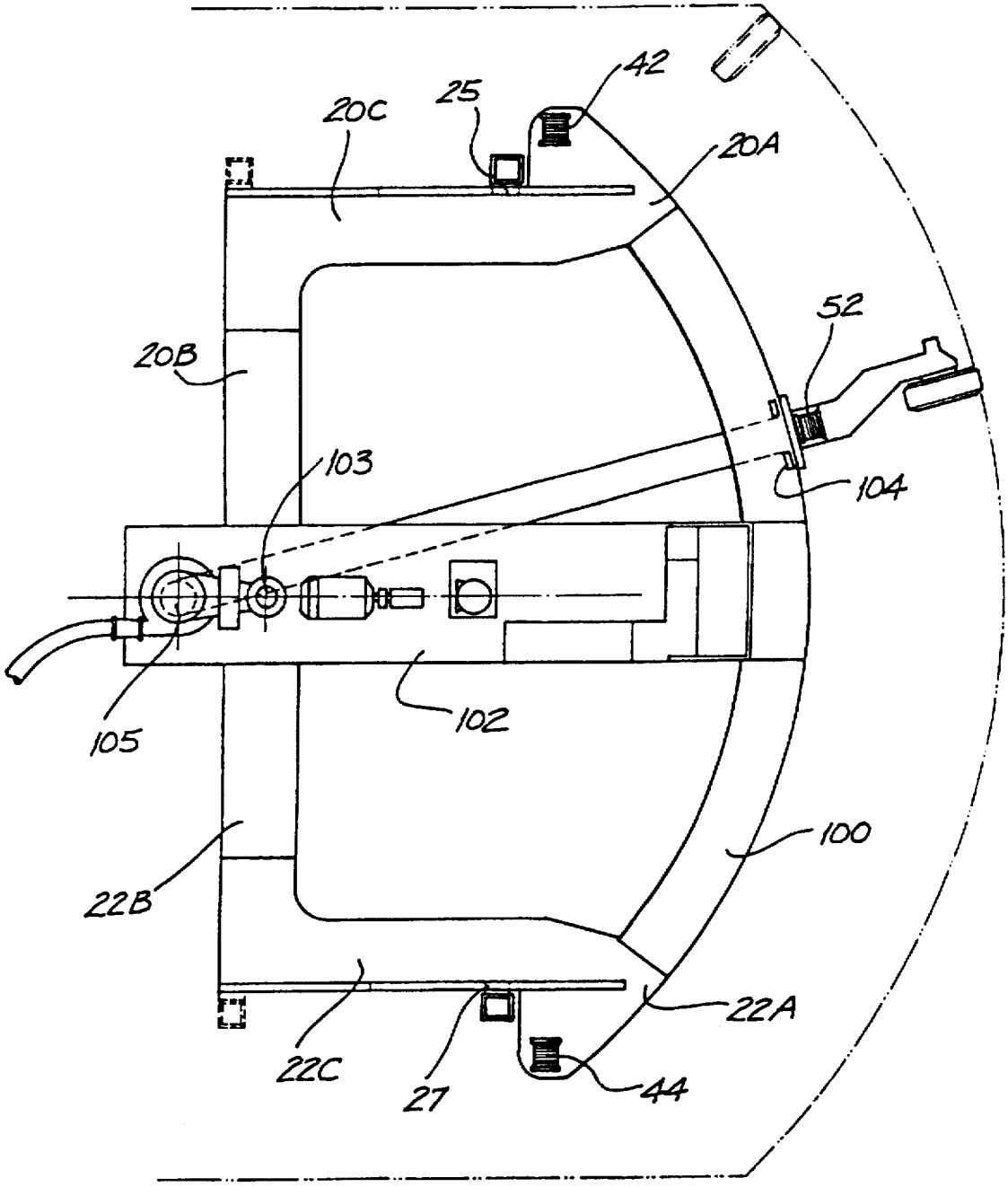
FIG. 3 is a plan view of a third preferred embodiment of the dredge.

A second preferred embodiment of the invention is shown in FIG. 2. This second preferred embodiment uses a similar U-shaped pontoon arrangement, but in this case a separate dredge is not used. Instead, substantially all of the equipment which was carried on dredge 10 in the first preferred embodiment is now mounted directly onto U-shaped pontoon 18.

The slewing motion of dredge 10 in the first preferred embodiment is replaced by a slewing motion of dredge ladder 14 in the second embodiment. As before, slewing motion of cutter head 16 is provided by forces applied via slew winches to slew wires 30 and 32. However, in the present embodiment, first slew winch 42 and second slew winch 44 can be mounted on first leg 20 and second leg 22. A possible alternative position for second slew winch 44 is that shown as slew winch 46. An analogous alternative position is also possible for first slew winch 42.

Arm 48, float 50, and bucket winch 52 can be provided in the second embodiment for raising and lowering cutter head 16.

A third preferred embodiment of the invention is shown in FIGS. 3 to 6. This third embodiment uses an arrangement which is generally similar to the second embodiment and in which similar components are given the same reference numbers, but in which the float 50 and the arm 48 of that second embodiment are replaced by a curved beam 100 which extends between the "free" ends 20A,22A of the legs 20 and 22 respectively and an enlarged centre beam 102. The enlarged centre beam 102 extends from the mid point of the curved beam 100, past the point 103 where legs 20 and 22 meet and protrudes beyond the stern of the dredge.

Comparing the arrangement shown in FIGS. 3 to 6 with that of the second embodiment, it can be seen that legs 20 and 22 are L-shaped rather than curved, having first portions 20B and 22B, respectively, which extend away from the centre beam 102 in substantially perpendicular direction to that beam, and second portions 20C and 22C, respectively, which are oriented generally parallel to centre beam 102. In this case, the effective longitudinal axes of legs 20 and 22 extend from their "free" ends 20A,22A respectively to point 103.

Centre beam 102 is substantially enlarged compared to arm 48 so that it forms a pontoon which is capable of carrying the machinery and controls for the dredge.

The curved beam 100 supports a carriage 104 which is arranged to run along the foremost side of the curved beam 100 and which supports the ladder winch 52. The provision of the curved beam 100 extending between the "free" ends of the legs 20 and 22 reduces the torsional stress on the legs in comparison with the second embodiment.

The ladder 14 runs from a cutter head 16 disposed in front of the dredge under the dredge pontoon itself to a pivot plate 105 located at the stern of the centre pontoon 102. Since this embodiment has a flat topped full depth beam 100 running across the bow of the dredge to support the carriage, there is no provision for lifting the ladder 14 out of the water to service the cutter head 16. Instead the ladder 14 comprises a first portion 14A and a second portion 14B joined by a hydraulically operated hinge 106, best seen in FIG. 4. The hinge 106 is provided to lift the cutter head out of the water in the following manner.

Figure 4:
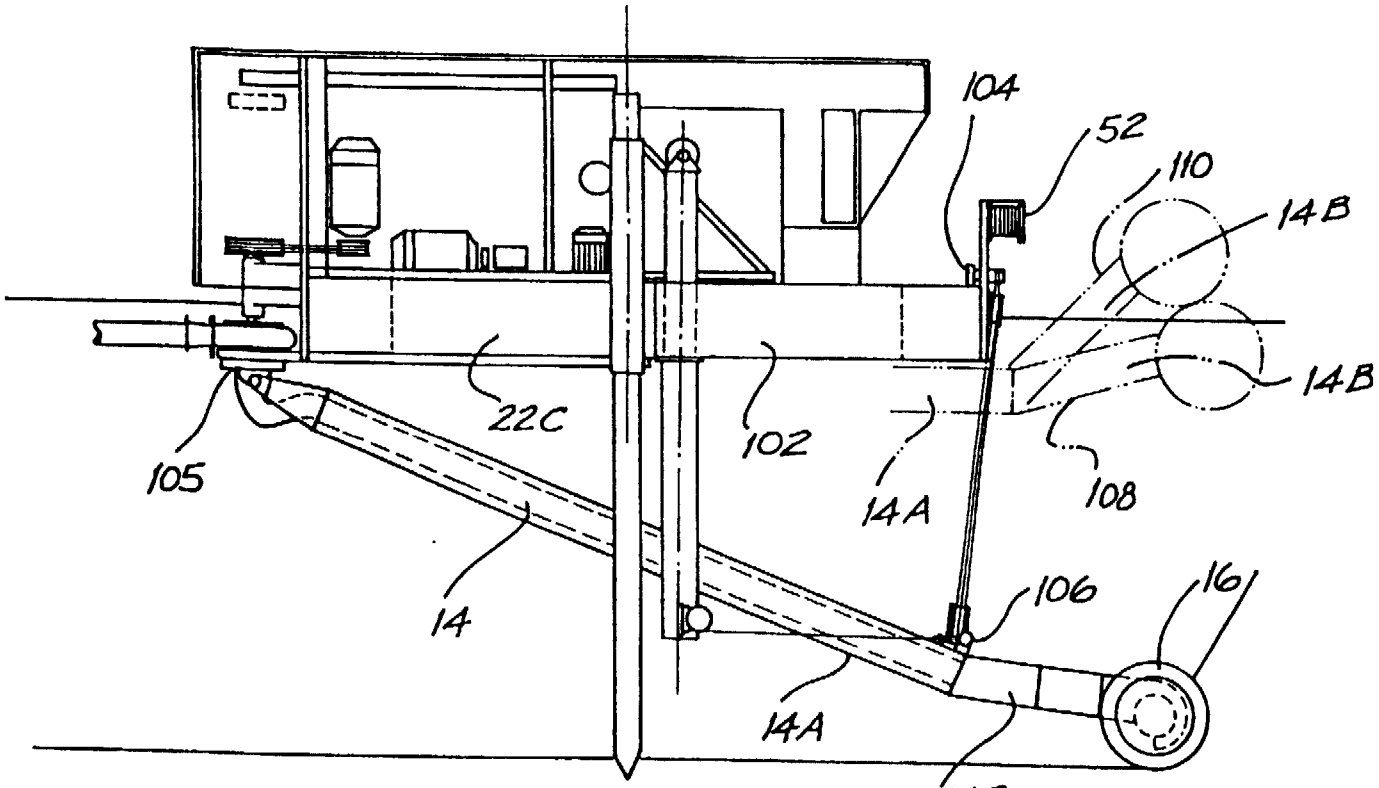
FIG. 4 is a side elevation of the third embodiment looking at the starboard side of the dredge.
Figure 5:
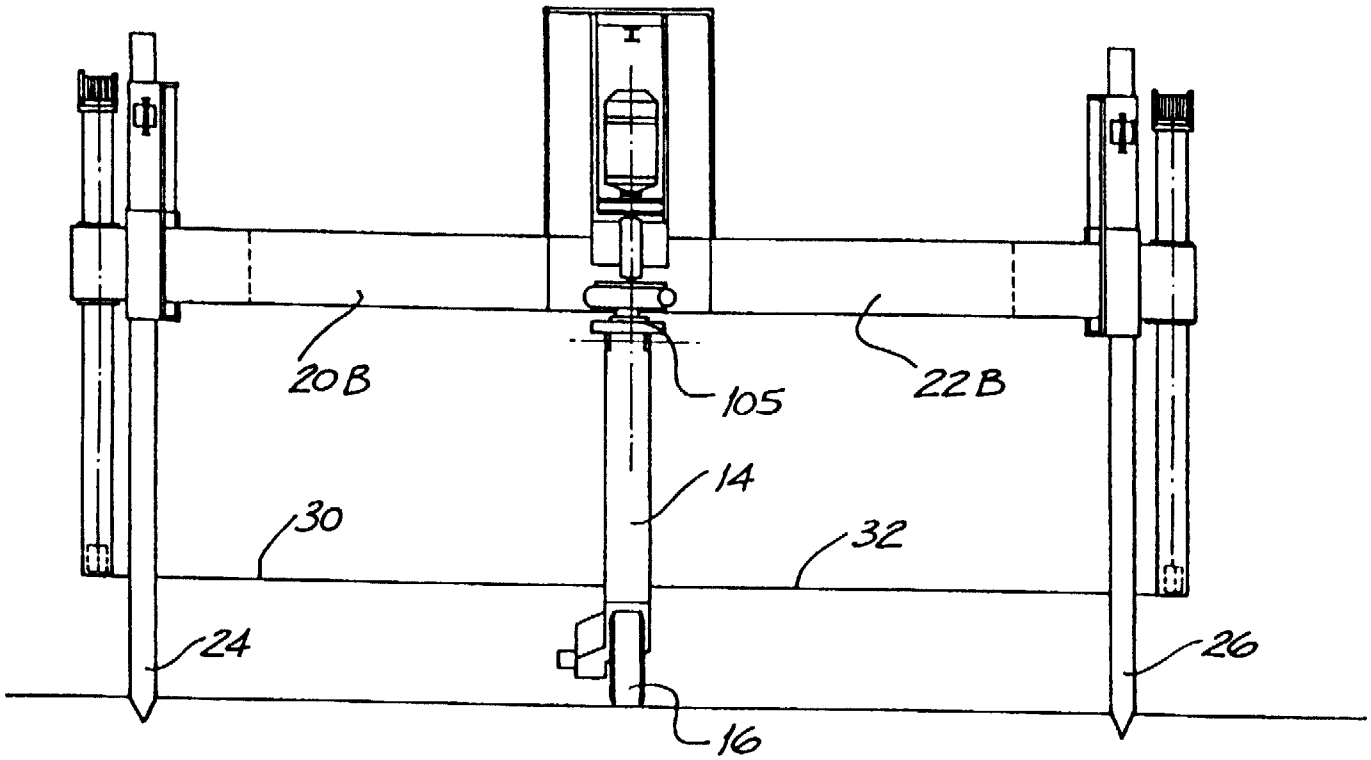
FIG. 5 is an end elevation of the third embodiment looking at the stern of the dredge.
Figure 6:
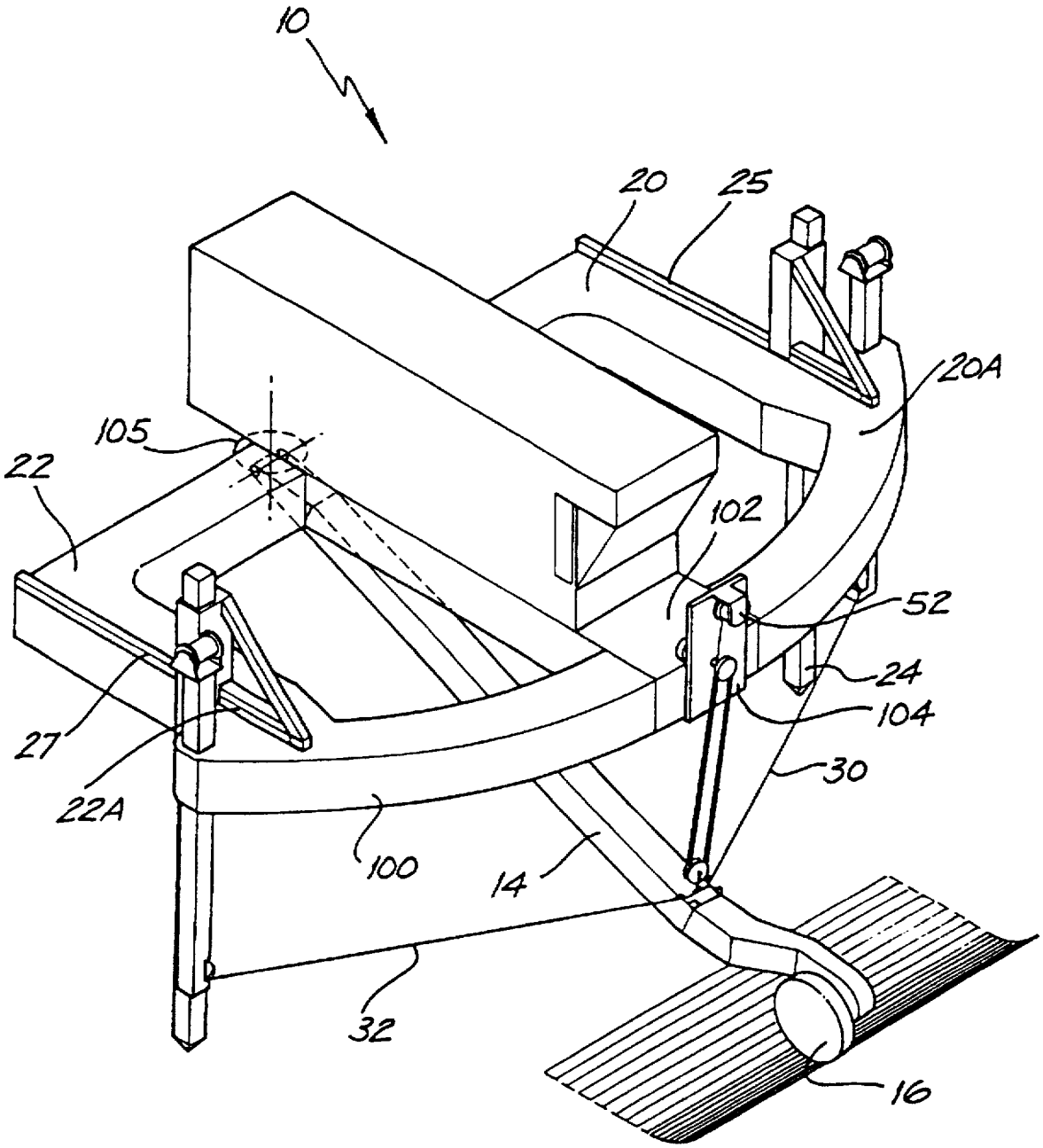
FIG. 6 is an isometric projection of the third embodiment.

First the winch 52 is operated to raise the ladder 14 until the ladder is in a position (indicated in outline in FIG. 4 and referenced 108) where the ladder is substantially parallel to and just below the centre pontoon 102 when the cutter head 16 will just break the surface of the water. Then the hinge is operated to rotate the remote portion 14B of the ladder relative to the portion 14A to bring the cutter head 16 upwards out of the water or towards centre pontoon 102 so that it is in position 110 as shown in FIG. 4.

Servicing of the hinge and the stern end of the ladder is carried out by lowering the ladder so that the head 16 rests on the bottom of the pond and acts as an anchor, raising the spuds, and slewing the dredge round in relation to the ladder until the ladder can be lifted out of the water alongside the stern of the dredge, using the top of a raised spud as a lifting point.

The pump and pivot plate 105 can also be lifted to expose the entire ladder 14 and pivot plate.

In the first, second and third preferred embodiments described above, the lengths of slew wires 30 and 32 are less than in conventional dredges. Thus, these slew wires are less elastic than corresponding wires in conventional dredges, and this allows the present invention to be positioned and controlled more accurately than conventional dredges.

Thus an improved dredge has been described in which accurate and firm positioning is obtained through the use of a U, V-or B-shaped floating pontoon.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

I claim:

1. A dredge comprising:

a pontoon including a first leg having a forward end and a first longitudinal axis and a second leg having a forward end and a second longitudinal axis, the first leg and the second leg being oriented such that the first longitudinal axis and the second longitudinal axis diverge from one another toward said respective forward ends and define an included angle, the included angle being less than 180 degrees;

first anchoring means mounted on the first leg adjacent to said forward end of the first leg for anchoring the first leg to an adjacent substrate;

second anchoring means mounted on the second leg adjacent to said forward end of the second leg for anchoring the second leg to the adjacent substrate;

collection means, attached pivotally to the pontoon between the first leg and the second leg and rearwardly of said first and second legs, for collecting dredgeable material;

slewing means associated with the first leg and the second leg for causing the collection means to slew between the first and second leg about a substantially vertical axis; and advancing means for causing the pontoon to advance relative to the adjacent substrate.

2. The dredge as claimed in claim 1, wherein the first and second anchoring means comprise respectively a first and second spud mounted slidably yet lockably on the respective first and second legs.

3. The dredge as claimed in claim 2, wherein the first and second spuds are each mounted on a slide connected to the respective first and second legs which constitute the advancing means.

4. The dredge as claimed in claim 1, wherein the collection means comprises a bucket wheel connected to a free end of a dredge ladder which comprises the slewing means.

5. The dredge as claimed in claim 1, wherein the pontoon is of a U-shape or a V-shape.

6. The dredge as claimed in claim 3, wherein the slides each extend in a direction substantially parallel to a longitudinal axis of the dredge.

7. The dredge as claimed in claim 2, wherein the first and second spuds respectively have lower ends provided respectively with a first and second sharp edge hollow cylinder for penetration into the adjacent substrate.

8. The dredge as claimed in claim 7, wherein the first and second cylinders are connected respectively to the first and second spuds by a release mechanism which releases the cylinder from the spud when the spud is subjected to shear forces or bending movements greater than a predetermine value.

9. The dredge as claimed in claim 1, wherein the pontoon includes a third leg intermediate the first leg and the second leg to which the collection means and the slewing means are attached.

10. The dredge as claimed in claim 9, wherein the third leg is flexibly coupled to the first and second legs.

11. The dredge as claimed in claim 9, wherein the third leg is formed integrally with the first and second legs.

12. The dredge as claimed in claim 11, wherein the free ends of the first, second and third legs of the pontoon are coupled together by a further pontoon leg.

13. The dredge as claimed in claim 4, wherein the slewing means includes slewing wires extending from the dredge ladder adjacent the bucket wheel respectively to members extending downwardly from each leg of the pontoon.

14. The dredge as claimed in claim 13, wherein the members extending downwardly from each leg of the pontoon comprise the anchoring means.

15. The dredge as claimed in claim 4, wherein the dredge ladder is provided with a hinged joint adjacent the bucket wheel so constructed that the bucket wheel to be raised relative to a longitudinal axis of the dredge ladder for servicing.

* * * * *